US007462782B2

(12) United States Patent
Clark

(10) Patent No.: US 7,462,782 B2
(45) Date of Patent: Dec. 9, 2008

(54) ELECTRICAL CABLE COMPRISING GEOMETRICALLY OPTIMIZED CONDUCTORS

(75) Inventor: William T. Clark, Lancaster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 11/440,553

(22) Filed: May 25, 2006

(65) Prior Publication Data

US 2006/0207786 A1 Sep. 21, 2006

Related U.S. Application Data

(62) Division of application No. 10/465,017, filed on Jun. 19, 2003, now abandoned.

(51) Int. Cl.
*H01B 7/00* (2006.01)

(52) U.S. Cl. ..... 174/110 R; 174/27; 174/113 R

(58) Field of Classification Search ..... 174/110 R, 174/113 R, 115, 27

See application file for complete search history.

(56) References Cited

U.S. PATENT DOCUMENTS

| | | | | |
|---|---|---|---|---|
| 867,659 | A | 10/1907 | Hoopes et al. | |
| 1,132,452 | A | 3/1915 | Davis | |
| 1,700,606 | A | 1/1929 | Beaver | |
| 1,853,677 | A * | 4/1932 | Fischer | 174/32 |
| 2,149,772 | A | 3/1939 | Hunter et al. | |
| 2,218,830 | A | 10/1940 | Rose et al. | |
| 2,583,025 | A | 1/1952 | Swift | |
| 2,583,026 | A | 1/1952 | Swift et al. | |
| 3,055,967 | A | 9/1962 | Bondon | |
| 3,191,005 | A | 6/1965 | Cox | |
| 3,259,687 | A | 7/1966 | Oatess et al. | |
| 3,328,510 | A | 6/1967 | White | |
| 3,340,112 | A | 9/1967 | Davis et al. | |
| 3,559,390 | A | 2/1971 | Staschewski | |
| 3,987,239 | A | 10/1976 | Chen et al. | |
| 3,999,003 | A | 12/1976 | Poull et al. | |
| 4,034,148 | A | 7/1977 | Lang | |
| 4,487,992 | A | 12/1984 | Tomita | |
| 4,568,401 | A * | 2/1986 | Davis | 156/55 |
| 4,697,051 | A | 9/1987 | Beggs et al. | |
| 4,767,891 | A | 8/1988 | Biegon et al. | |
| 4,777,325 | A | 10/1988 | Siwinski | |
| 4,778,246 | A | 10/1988 | Carroll | |
| 4,800,236 | A | 1/1989 | Lemke | |
| 4,847,443 | A | 7/1989 | Basconi | |
| 5,015,800 | A | 5/1991 | Vaupotic et al. | |
| 5,043,530 | A | 8/1991 | Davies | |
| 5,068,497 | A | 11/1991 | Krieger | |
| 5,073,682 | A | 12/1991 | Walling et al. | |

(Continued)

FOREIGN PATENT DOCUMENTS

| | | |
|---|---|---|
| CA | 1164064 | 4/1981 |

(Continued)

*Primary Examiner*—Chau N Nguyen
(74) *Attorney, Agent, or Firm*—Lowrie, Lando & Anastasi, LLP

(57) ABSTRACT

A number of examples of insulated conductors having geometrically optimized shapes and form factors, that may be used in twisted-pair cables and other types of communication cable to enhance the performance of, and/or reduce the cost of manufacturing such cables.

8 Claims, 8 Drawing Sheets

U.S. PATENT DOCUMENTS

| | | | | |
|---|---|---|---|---|
| 5,097,099 | A | 3/1992 | Miller | |
| 5,132,488 | A | 7/1992 | Tessier et al. | |
| 5,132,490 | A | 7/1992 | Aldissi | |
| 5,142,100 | A | 8/1992 | Vaupotic | |
| 5,155,304 | A | 10/1992 | Gossett et al. | |
| 5,170,010 | A | 12/1992 | Aldissi | |
| 5,179,251 | A * | 1/1993 | Mullin et al. | 174/23 C |
| 5,180,890 | A | 1/1993 | Pendergrass | |
| 5,202,946 | A | 4/1993 | Hardin et al. | |
| 5,220,130 | A | 6/1993 | Walters | |
| 5,222,177 | A | 6/1993 | Chu et al. | |
| 5,245,134 | A | 9/1993 | Vana, Jr. et al. | |
| 5,286,924 | A | 2/1994 | Loder et al. | |
| 5,313,020 | A | 5/1994 | Sackett | |
| 5,393,933 | A | 2/1995 | Goertz | |
| 5,399,813 | A | 3/1995 | McNeill et al. | |
| 5,430,255 | A | 7/1995 | Downie et al. | |
| 5,541,361 | A | 7/1996 | Friesen et al. | |
| 5,563,377 | A | 10/1996 | Arpin et al. | |
| 5,574,250 | A | 11/1996 | Hardie et al. | |
| 5,658,406 | A | 8/1997 | Walling et al. | |
| 5,666,452 | A | 9/1997 | Deitz, Sr. et al. | |
| 5,670,748 | A | 9/1997 | Gingue et al. | |
| 5,767,441 | A | 6/1998 | Brorein et al. | |
| 5,777,273 | A * | 7/1998 | Woody et al. | 174/113 R |
| 5,821,467 | A | 10/1998 | O'Brien et al. | |
| 5,841,073 | A * | 11/1998 | Randa et al. | 174/113 R |
| 5,883,334 | A | 3/1999 | Newmoyer et al. | |
| 5,900,588 | A | 5/1999 | Springer et al. | |
| 5,920,672 | A | 7/1999 | White | |
| 5,956,445 | A | 9/1999 | Deitz, Sr. et al. | |
| 5,990,419 | A | 11/1999 | Bogese, II | |
| 6,037,546 | A | 3/2000 | Mottine et al. | |
| 6,074,503 | A | 6/2000 | Clark et al. | |
| 6,091,025 | A | 7/2000 | Cotter et al. | |
| 6,162,992 | A | 12/2000 | Clark et al. | |
| 6,225,563 | B1 * | 5/2001 | Poulsen | 174/117 FF |
| 6,272,828 | B1 | 8/2001 | Walling et al. | |
| 6,300,573 | B1 | 10/2001 | Horie et al. | |
| 6,307,156 | B1 * | 10/2001 | Avellanet | 174/128.1 |
| 6,353,177 | B1 * | 3/2002 | Young | 174/42 |
| 6,392,152 | B1 | 5/2002 | Mottine, Jr. et al. | |
| 6,403,887 | B1 | 6/2002 | Kebabjian et al. | |
| 6,570,095 | B2 | 5/2003 | Clark et al. | |
| 6,596,944 | B1 | 7/2003 | Clark et al. | |
| 6,639,152 | B2 | 10/2003 | Glew et al. | |
| 6,753,476 | B1 | 6/2004 | Rodway et al. | |
| 6,753,478 | B2 | 6/2004 | Rodway et al. | |
| 6,770,819 | B2 | 8/2004 | Patel | |
| 6,789,311 | B2 | 9/2004 | Fidi et al. | |
| 2005/0087361 | A1 | 4/2005 | Hayes et al. | |
| 2006/0059883 | A1 | 3/2006 | Hopkinson et al. | |

FOREIGN PATENT DOCUMENTS

| | | | |
|---|---|---|---|
| DE | 2555670 | A | 6/1997 |
| EP | 0 258 036 | | 3/1988 |
| EP | 0 718 913 | A | 11/1995 |
| EP | 1 130 604 | A | 9/2001 |
| EP | 1296336 | A1 | 8/2002 |
| FR | 2 751 779 | A1 | 1/1998 |
| GB | 361930 | | 11/1931 |
| GB | 486970 | | 6/1938 |
| GB | 1120319 | | 12/1965 |
| GB | 2 234 389 | A | 1/1991 |
| JP | 59-160913 | A | 11/1984 |
| JP | 5159628 | A | 6/1993 |
| JP | 5-325660 | | 12/1993 |
| WO | WO 96/34400 | A1 | 10/1996 |
| WO | WO 01/93281 | A | 12/2001 |
| WO | WO 2005/041219 | A1 | 5/2005 |

* cited by examiner

ELECTRICAL CABLE COMPRISING GEOMETRICALLY OPTIMIZED CONDUCTORS

RELATED APPLICATIONS

This application is a divisional application, and claims the benefit under 35 U.S.C. §120, of now abandoned U.S. patent application Ser. No. 10/465,017, entitled "Electrical Cable Comprising Geometrically Optimized Conductors," filed on Jun. 19, 2003, which is herein incorporated by reference in its entirety.

BACKGROUND

1. Field of the Invention

The present invention relates to insulated electrical conductors that may be used in data cables, such as twisted pair cables, and in particular to insulated conductors that are geometrically optimized for superior performance.

2. Discussion of the Related Art

Data and other communication cables, such as, for example, shielded or unshielded twisted pair cables often include several insulated conductors for carrying electrical signals. Referring to FIG. 1, there is illustrated, in widthwise cross-section, one example of a conventional insulated conductor 100. The insulated conductor comprises a round metal core 102 surrounded by an insulating layer 104 that is also substantially circular in cross-section, as illustrated.

When two conventional insulated conductors 100 are twisted together to form a twisted pair, the conventional round insulated conductors do not stay in physical contact along their entire lengths, but rather tend to nest in some places and separate in others along their twisted length. This results in a variable air gap between the two conductors along the length of the twisted pair, which affects the impedance of the twisted pair. For example, for insulated conductors having a 0.035 inch diameter, there is generally a 0.002-0.004 inch variation in the air gap between the conductors along their twisted length, resulting in a rough impedance over the operating frequency of the twisted pair.

SUMMARY OF THE INVENTION

Aspects and embodiments of the invention are directed to various configurations of electrical conductors with shaped insulation layer(s) and/or shaped conductive cores.

According to one embodiment, an insulated conductor may comprise a conductive core, and a first insulating layer surrounding the conductive core along its length, wherein the first insulating layer has a non-circular outer circumference, the outer circumference not including any projections extending outwardly from the outer circumference of the first insulating layer. In one example, the first insulating layer may have a substantially oval-shaped widthwise cross-section. In another example, the first insulating layer may comprise thicker portions and thinner portions so as to provide the oval widthwise cross-section, and may include two indentations in the thinner portions, the two indentations disposed substantially opposite one another. In other examples, the first insulating layer may define a cavity or a plurality of indentations extending toward, but not reaching, the conductive core. The first insulating layer may comprise, for example, a polyolefin material or a fluoropolymer.

Another embodiment is directed to a twisted pair of insulated conductors comprising a first insulated conductor comprising a first conductive core and a first insulating layer surrounding the first conductive core along its length, and a second insulated conductor comprising a second conductive core and a second insulating layer surrounding the second conductive core along its length, wherein the first and second insulating layers have a substantially oval widthwise cross-section, and wherein the first and second insulated conductors are twisted together to form the twisted pair. In one example, the first and second insulated conductors may be helically twisted together such that major axes of the first and second insulating layers periodically contact one another so as to provide a back-tensioning effect between the first and second insulated conductors after twist. In another example, the first and second insulating layers may comprise thicker portions and thinner portions, so as to provide the oval cross-section, and each of the first and second insulating layers may comprise two indentations in the thinner portions, the two indentations disposed substantially opposite one another. In another example, each of the first and second insulating layers may comprise a cavity extending toward, but not reaching, the first and second conductive cores, respectively. At least one the first and second insulating layers may comprise, for example, a polyolefin material.

In another embodiment, a data cable may comprise a plurality of twisted pairs of insulated conductors, each twisted pair comprising a first insulated conductor and a second insulated conductor helically twisted together with the first insulated conductor, and a jacket surrounding the plurality of twisted pairs of insulated conductors along a length of the data cable, wherein the first and second insulated conductors each comprise a conductive core insulated by an insulating layer, the insulating layer having a substantially non-circular outer circumference, wherein the outer circumference excludes any projections extending outwardly from the insulating layer. For example, the insulating layer may have a substantially oval widthwise cross-section.

According to one embodiment, an insulated conductor may comprise a metal core and an insulating layer surrounding the metal core, wherein the metal core is has an irregularly-shaped outer surface that defines a plurality of indentations spaced about a circumference of the metal core.

According to another embodiment, an insulated conductor may comprise a metal core and an insulating layer surrounding the metal core, the insulating layer including a plurality of fine filaments projecting outwardly from an outer surface of the insulating layer.

According to another embodiment, a twisted pair of insulated conductors may comprise a first insulated conductor including a first metal core and a first insulating layer surrounding the first metal core, the first insulating layer comprising a first plurality of openings disposed about an outer surface of the first insulating layer and extending inward toward the first metal core, and a second insulated conductor including a second metal core and a second insulation layer surrounding the second metal core, the second insulating layer comprising a second plurality of openings disposed about an outer surface of the second insulating layer and extending inward toward the second metal core. The first and second insulated conductors are twisted together to form the twisted pair.

In a further embodiment, a twisted pair of insulated conductors may comprise a first insulated conductor including a first metal core, a first insulating layer surrounding the first metal core, and a second insulating layer surrounding the first insulating layer. The twisted pair further comprises a second insulated conductor including a second metal core, a third insulating layer surrounding the second metal core, and a fourth insulating layer surrounding the third insulating layer.

The first and third insulating layers each may be constructed to define at least one void within each of the first and third insulating layers, and the first and second insulated conductors may be twisted together to form the twisted pair.

According to yet another embodiment, a cable may comprise a plurality of twisted pairs of insulated conductors, each twisted pair including a first insulated conductor and a second insulator conductor twisted together in a helical manner, wherein each of the first and second insulated conductor has a substantially non-circular widthwise cross-section.

According to another embodiment, an insulated conductor may comprise a metal core, and an insulation layer surrounding the metal core. The insulation layer may comprise a first annular region of a first insulation material, the first annular region shaped so as to define a plurality of indentations along a circumference of the first annular region, a second annular region of the first insulation material, and a third annular region of a second insulation material. In one example, the first annular region may be disposed adjacent the metal core and the plurality of indentations are disposed along an inner circumference of the first annular region, adjacent the metal core. In another example, the first annular region may be disposed between the second and third annular regions such that the plurality of indentations is disposed along an interface between the first annular region and the second annular region. In yet another example, the first annular region may be disposed between the second and third annular regions such that the plurality of indentations is disposed along an interface between the first annular region and the third annular region.

According to another embodiment, a method of making a twisted pair of insulated conductors comprises abrading an outer surface of a first metal core so as to provide the first metal core with an irregularly-shaped outer surface having a first plurality of indentations, and surrounding the first metal core with a first insulating layer to provide a first insulated conductor. The method further includes abrading an outer surface of a second metal core so as to provide the second metal core with an irregularly-shaped outer surface having a second plurality of indentations, surrounding the second metal core with a second insulating layer to provide a second insulated conductor, and twisting together the first and second insulated conductors to form the twisted pair.

BRIEF DESCRIPTION OF THE DRAWINGS

In the figures, in which like elements are represented by like reference numerals.

DETAILED DESCRIPTION

Figure 1:
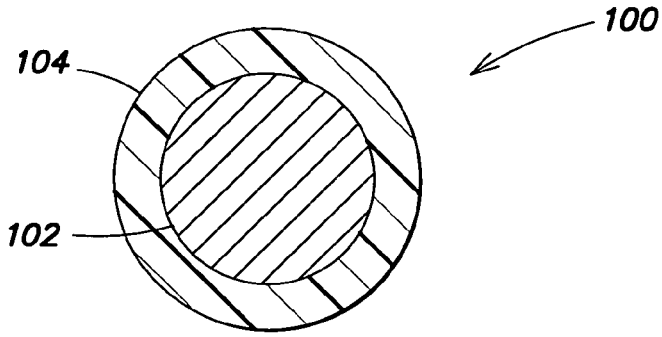
FIG. 1 (Prior Art)
FIG. 1 is a cross-sectional diagram of a conventional round insulated conductor.

Various illustrative embodiments and examples of the present invention and aspects thereof will now be described in more detail with reference to the accompanying figures. It is to be understood that the invention is not limited in its application to the details of construction and the arrangement of components set forth in the following description or illustrated in the drawings. Other applications, details of construction, arrangement of components, embodiments and aspects of the invention are possible. Also, it is further to be understood that the phraseology and terminology used herein is for the purpose of illustration and should not be regarded as limiting. The use of "including," "comprising," or "having," and variations thereof, is meant to encompass the items listed thereafter and equivalents thereof as well as additional items.

Figure 2:
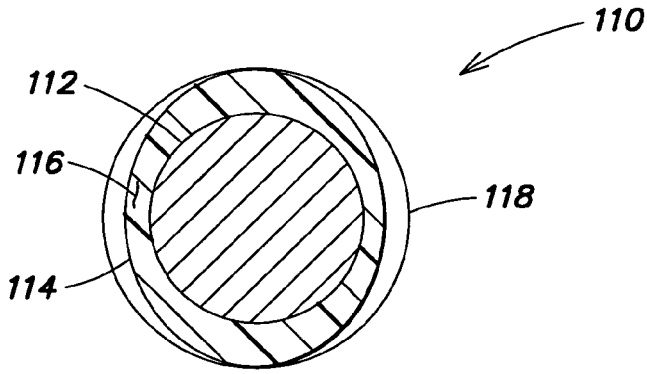
FIG. 2 is a cross-sectional diagram of a non-circular insulated conductor according to one embodiment of the invention.

Referring to FIG. 2, there is illustrated an insulated conductor 110 according to one embodiment of the invention. The insulated conductor 110 comprises a metal core (conductive core) 112 surrounded by an insulation layer 114. The metal core 112 may be a solid wire or wire strands of any suitable metal, such as, for example, copper. The insulation layer 114 may be any suitable insulating or dielectric material, such as a plastic material, for example, a polyolefin, a fluoropolymer and the like. Unlike the conventional insulated conductor 100 described above, the insulation layer 114 of this embodiment of the invention has a non-circular, oval or oblong shape in widthwise cross-section, as illustrated in FIG. 2. For the purposes of this specification, the term "widthwise cross-section" is intended to mean a cross-section taken, perpendicular to a length of the cable, across a width of the cable. Thus, the insulation layer 114 comprises thinner portions 116 as compared to a conventional round insulation layer, indicated by circle 118. This oval construction of the insulation layer 114 enables the insulated conductor 110 to be manufactured more cheaply than conventional insulated conductors because the insulated conductor 110 uses comparatively less insulation material for the insulation layer 114 (for same size metal cores 102, 112). In one example, the difference in volume of insulation material volume for insulation layer 114 compared with conventional insulation layer 104 may be about 3%.

Figure 15:
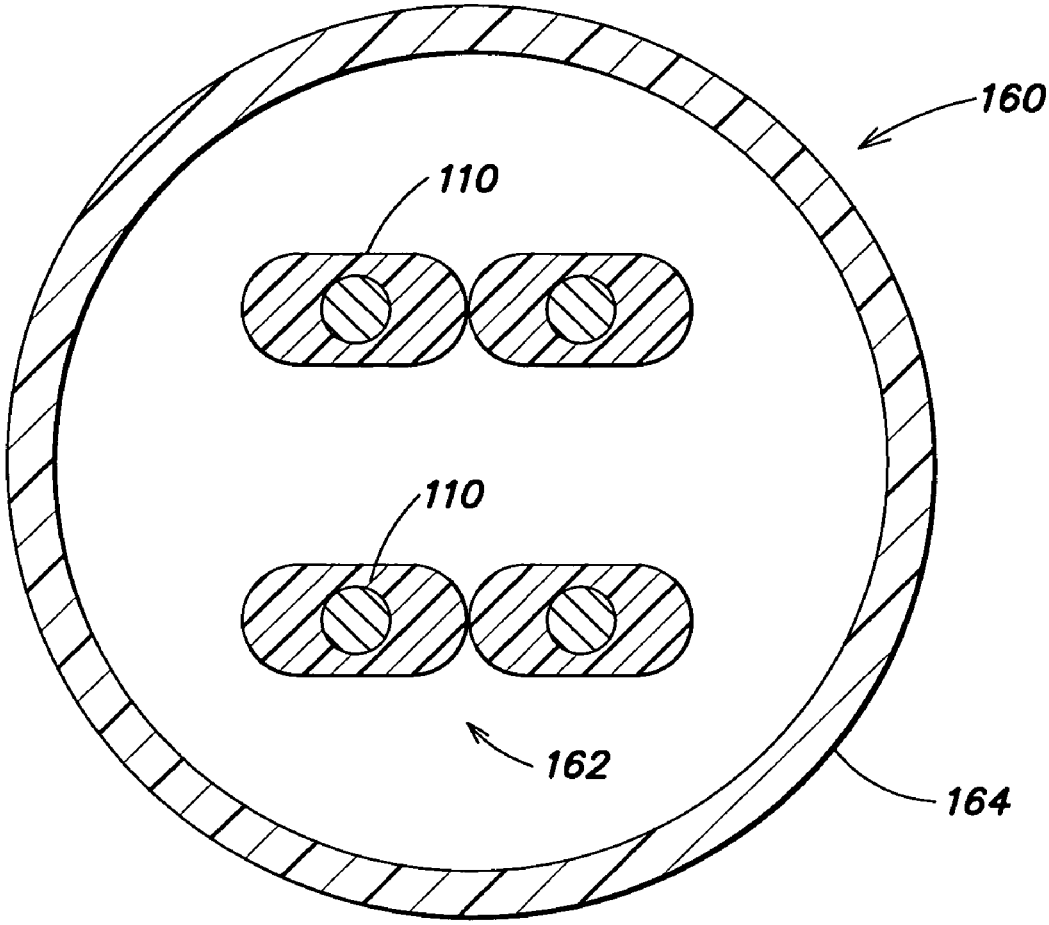
FIG. 15 is a cross-sectional diagram of a one embodiment of a cable including twisted pairs having non-circular insulations, in accordance with an embodiment of the invention.

The oval-shaped insulation layer, illustrated in FIG. 15, may result in improved electrical performance of the insulated conductor 110 compared to the conventional insulated conductor 100. For example, the twisting operation imparts a helical twist into each conductor which causes the major axes of the conductors to periodically contact each other, as shown in FIG. 15. This provides a back-tensioning effect between each conductor after twist, reducing air gap variability. In other words, periodic interfacing of major axes of the insulated conductors helps to provide a more restrained geometric equilibrium between the effective conductor center-to-center spacing. This enhanced equilibrium effect and uniform air gap results in a smoother impedance variability over the operating frequency range of the cable 160. Also, since the twist period is often a fraction of an inch, impact on any variations on the return loss of the twisted pair may occur at frequencies significantly above the operating frequency of the cable.

Figure 3A:
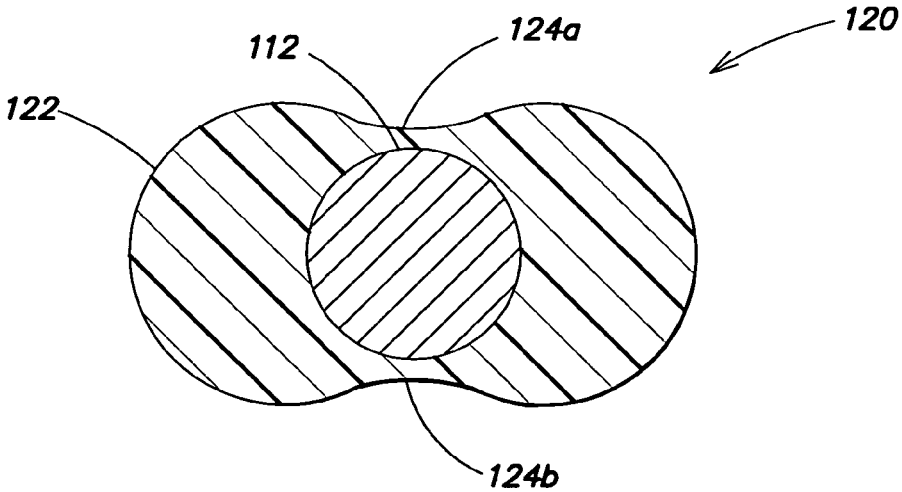
FIG. 3*a* is a cross-sectional diagram of a non-circular insulated conductor according to another embodiment of the invention.
Figure 3B:
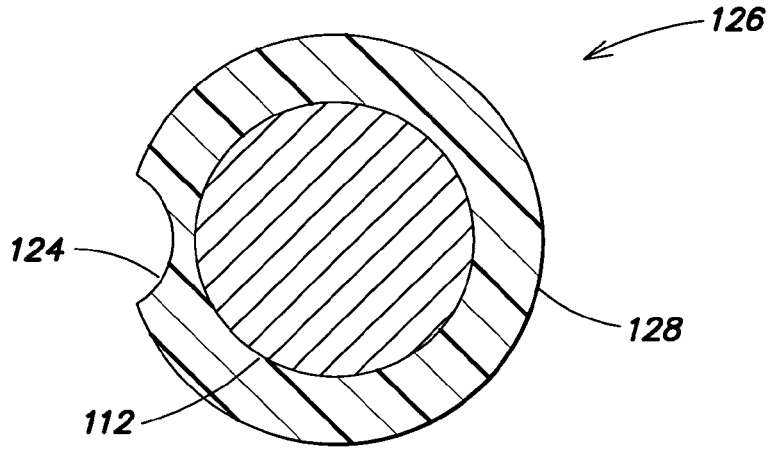
FIG. 3*b* is a cross-sectional diagram of an insulated conductor according to another embodiment of the invention.

According to another embodiment of the invention, an insulated conductor 120 comprises the metal core 112 surrounded by a differently-shaped non-circular insulating layer 122. The insulating layer 122 is substantially oval-shaped in widthwise cross-section, having two "cut-outs" or indentations 124*a*, 124*b* located in opposing sides of the insulating layer, as illustrated in FIG. 3*a*. The cut-outs 124*a*, 124*b* result in a cheaper construction of the insulated conductor 120 compared to a conventional insulated conductor because the insulating layer 122 uses comparatively less material. It is to be appreciated that the invention is not limited to the example illustrated in FIG. 3*a*. In particular, the non-circular insulating layer 122 may be configured to define more or fewer than two indentations 124*a*, 124*b*, and the indentations may not be concave, as illustrated, but may instead have, for example, a rectangular or other shape. In addition, although the indentations 124*a*, 124*b* may be referred to as "cut-outs" for the purposes of this description, they are not necessarily formed by cutting material out of the insulating layer 122, but may be formed by, for example, extruding the insulating layer 122 using a die to provide the indentations, or in another suitable way. Furthermore, the insulating layer 122 may not be substantially oval, as illustrated in FIG. 3*a*, but may have another shape. For example, referring to FIG. 3*b*, there is illustrated another example of an insulated conductor 126, including the metal core 112 surrounded by a non-circular insulating layer 128. The non-circular insulating layer 128 defines an indentation 124. As discussed above, the insulating layer 128 may be constructed to define more than one indentation 124.

Figure 4:
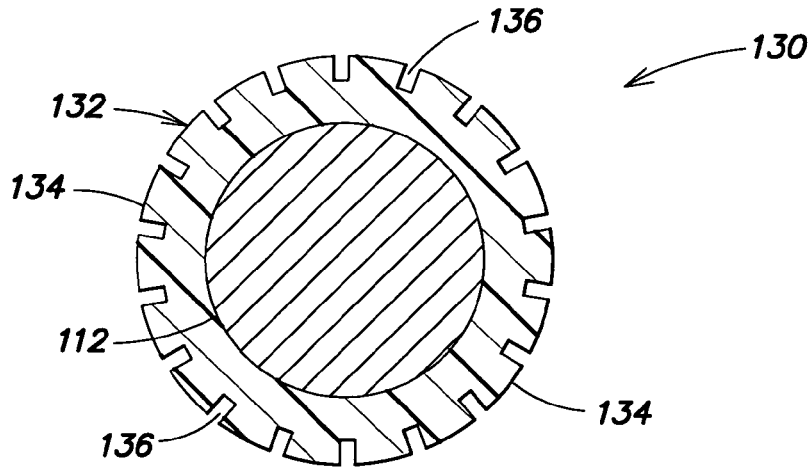
FIG. 4 is a cross-sectional diagram of an insulated conductor according to another embodiment of the invention.

Referring to FIG. 4, there is illustrated an insulated conductor 130 according to another embodiment of the invention. The insulated conductor 130 includes a metal core 112 surrounded by an insulating layer 132. The insulating layer 132 is constructed having a plurality of projections 134 so as to define a plurality of openings 136 spaced about an outer circumference of the insulating layer 132. Thus, the insulated conductor 130 has a striated appearance on its outer surface. The openings 136 are shaped and arranged to reduce the effective dielectric constant of the insulating layer 132 by a predetermined amount. A conventional insulating layer 104 has a dielectric constant that is determined by the material of which the insulating layer 104 is comprised. By reducing the amount of insulating material and effectively replacing the dielectric material with air (by providing the openings 136), the effective dielectric constant of the insulating layer 132 is reduced.

Near-end cross talk (NEXT) between twisted pairs of insulated conductors (i.e., interference of noise from one twisted pair with the signal carried on another twisted pair) is directly dependent on the capacitance unbalance between the conductors of adjacent twisted pairs, which is in turn proportional to the dielectric constant of the material between the conductors. Therefore, reducing the effective dielectric constant of the insulating layer 132, using precision geometry rather than conventional and less precise foaming technology, reduces the capacitance and relative capacitance unbalance, and thus the NEXT, between adjacent twisted pairs of insulated conductors. Additionally, lower capacitance lowers signal attenuation and signal propagation time through a twisted pair of the insulated conductors.

Figure 5A:
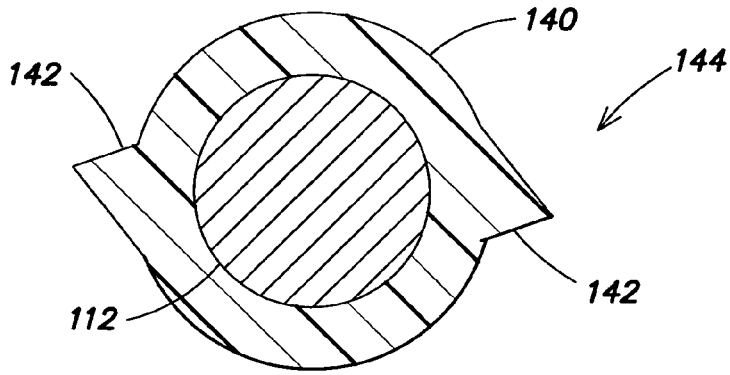
FIG. 5*a* is a cross-sectional diagram of an insulated conductor according to another embodiment of the invention.

According to another embodiment of the invention, illustrated in FIG. 5*a*, an insulation layer 140 of an insulated conductor 144 may be provided with one or more outwardly projecting fins 142. It is to be understood that while the fins 142 are illustrated in cross-section in FIG. 5*a*, the fins 142 extend along the length of the insulated conductor and form helical ridges when the insulated conductor 144 is twisted together with another insulated conductor 144 to form a twisted pair. The fins 142 cause a physical separation between the two conductors, creating a gap between the two conductors of the twisted pair. The fins 142 help to maintain a constant gap between the two conductors, whereas when two conventional, round insulated conductors are twisted together, there is generally some variation in the gap between the two conductors, as discussed above. Due to helical nature of twisting, the fins may periodically abut one another. The fins may undergo some degree of compression when they abut one another, the degree of compression depending, at least in part, on the insulation material used. This compression may serve to provide a counter-balance of force between the conductors, depending on the elastomeric properties of the insulation. The shape of the fins can be designed to provide a linear back-force or, as in an apex, a non-linear back-force with respect to conductor-to-conductor proximity. Of course, the invention is not limited to the insulated conductor illustrated in FIG. 5*a*, and includes many variations on the number, size and shape of the fins 142. For example, there is illustrated in FIG. 5*b* another example of an insulated conductor having an insulation layer 146 that defines four fins 148 that each has a slightly asymmetrical shape.

Figure 5B:
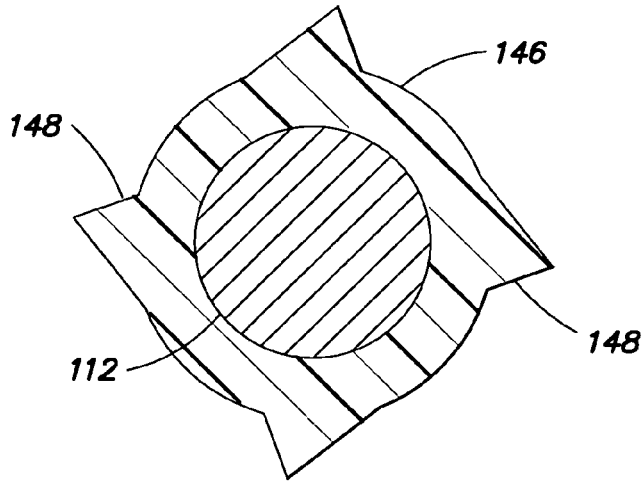
FIG. 5*b* is a cross-sectional diagram of an insulated conductor according to yet another embodiment of the invention.
Figure 6:
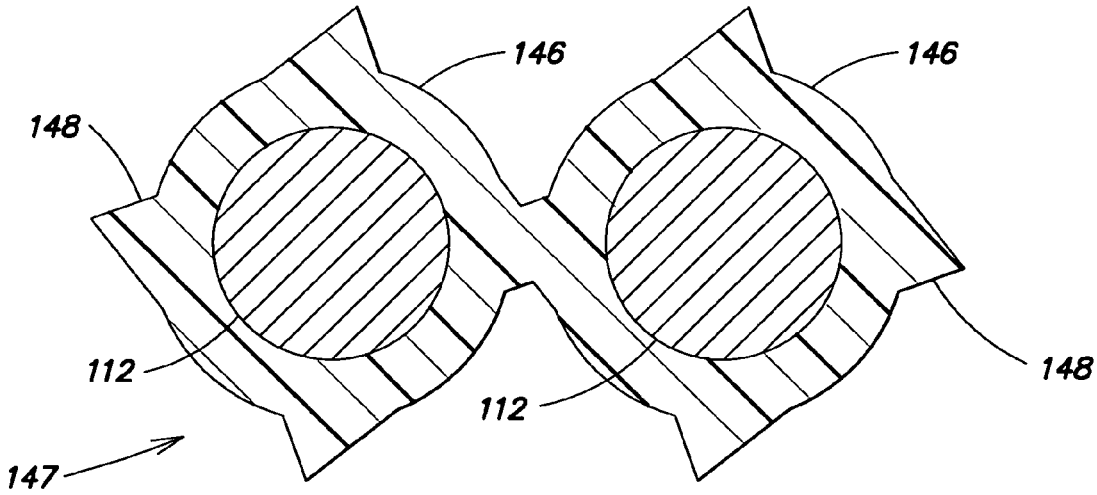
FIG. 6 is a cross-sectional diagram of a twisted pair of the insulated conductors of FIG. 5*b* according to the invention.

Referring to FIG. 6, there is illustrated one example, in cross-section, of a twisted pair of the insulated conductors of FIG. 5*b*. As illustrated, the fins 148 of each conductor of the twisted pair may abut against each other, such that the conductors form an intra-locked pair 147. Conventional round insulated conductors have a tendency to untwist once they have been twisted together to form a twisted pair. The fins 148 inhibit untwisting of the intra-locked pair 147 by providing a resistive force to any untwisting. Thus, using the fins 148 may obviate the need for a back-twisting machine or other apparatus used to prevent untwisting of conventional twisted pairs, although such an apparatus could still be used to backtwist the insulated conductors. It should be noted that the fins 148 do not need to completely intra-lock; as long as the fins from one conductor contact the fins of the other conductor, there may be provided sufficient resistance to inhibit untwisting. The illustrated intralocked twisted pair of FIG. 6 may be particularly conducive to manufacture, as each conductor rotates in the same direction during twist and the ratchet-like fins may be orientated to provided the least resistance to the direction of twist. Conversely, greater resistance occurs if the conductors were to twist in the opposite direction (i.e., attempt to untwist), thereby impeding untwisting.

Figure 7:
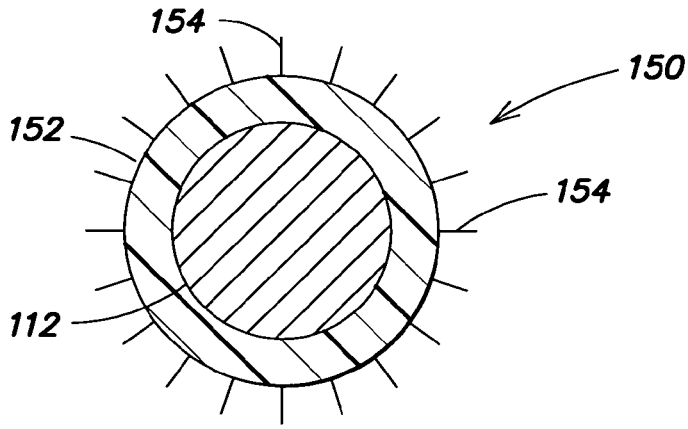
FIG. 7 is a cross-sectional diagram of an insulated conductor according to another embodiment of the invention.

Referring to FIG. 7, there is illustrated an insulated conductor 150 according to another embodiment of the invention. The insulating layer 152 comprises a plurality of fine, hair-like filaments 154 extending from an outer surface of the insulating layer 152. When two such insulated conductors 150 are twisted together to form a twisted pair, the filaments 154 may provide separation between the two insulated conductors. The filaments 154 may intertwine to create a "mesh insulating region" that has a lower effective dielectric constant than a solid material. The filaments 154 thus may act as a continuance of a lower dielectric constant version of insulation material between the conductors, having micro-gaps of air. The lower effective dielectric constant between the conductors may yield a lower variability of capacitance for a similar change in conductor-to-conductor spacing, thereby minimizing the electrical effects of micro-movement between the conductors. In one example, the solid portion of the insulating layer may be thinner than a conventional round insulating layer because the filaments cause additional space between the conductors.

Figure 8:
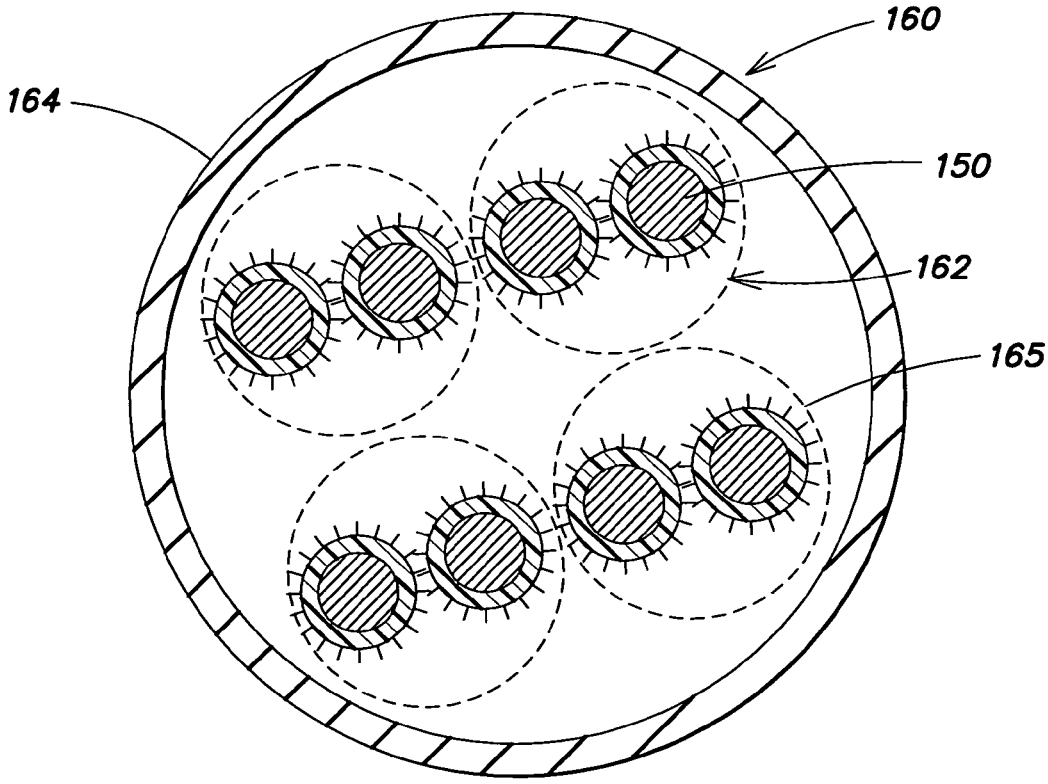
FIG. 8 is a schematic diagram of a cable including four twisted pairs of the insulated conductors of FIG. 7.

There is illustrated in FIG. 8, one embodiment of a four-pair, twisted pair cable 160 comprising twisted pairs 162 of the insulated conductors 150 of FIG. 7. The twisted pairs 162 are surrounded by a jacket 164 that may comprise any suitable jacketing material. The dotted lines 165 indicate an approximate outer circumference of the twisted pairs 162. It is to be appreciated that FIG. 8 is intended to illustrate a generic twisted pair cable using the insulated conductors of the invention. The cable 160 could, of course, comprise twisted pairs of any of the various embodiments of insulated conductors described herein, and could comprise more or fewer than four twisted pairs.

Figure 9:
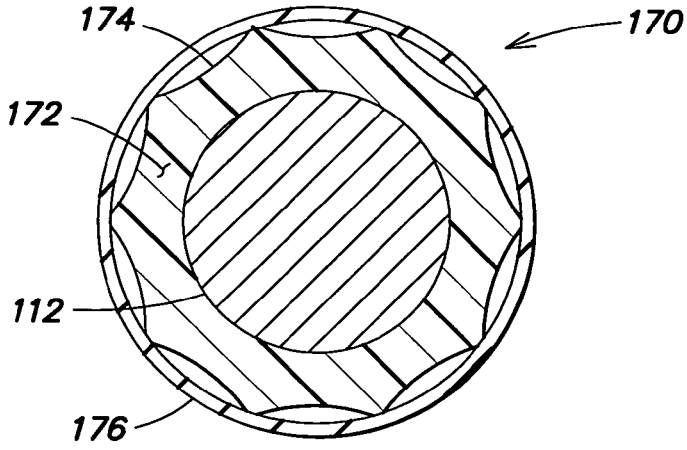
FIG. 9 is a cross-sectional diagram of an insulated conductor according to another embodiment of the invention.

According to another embodiment, an insulated conductor 170 may comprise a metal core 112 and an insulating layer 172 that defines a plurality of indentations 174 that result in an uneven outer circumference of the insulating layer 172, as illustrated in FIG. 9. The insulated conductor 170 may further comprise a second insulating layer 176 that surrounds the first insulating layer 172. The combination of the two insulating layers, 172, 176 results in the indentations 174 being closed cells spaced along an interface between the first and second insulating layers. In one example, the second insulating layer may be a thin film, as illustrated in FIG. 9. In another example, the closed cells 174 may be formed by, for example, extruding a single layer of insulation having gaps therein which provide the closed cells 174. The insulating layers may comprise, for example, any non-conductive material, preferably one having a low dielectric constant.

Figure 10:
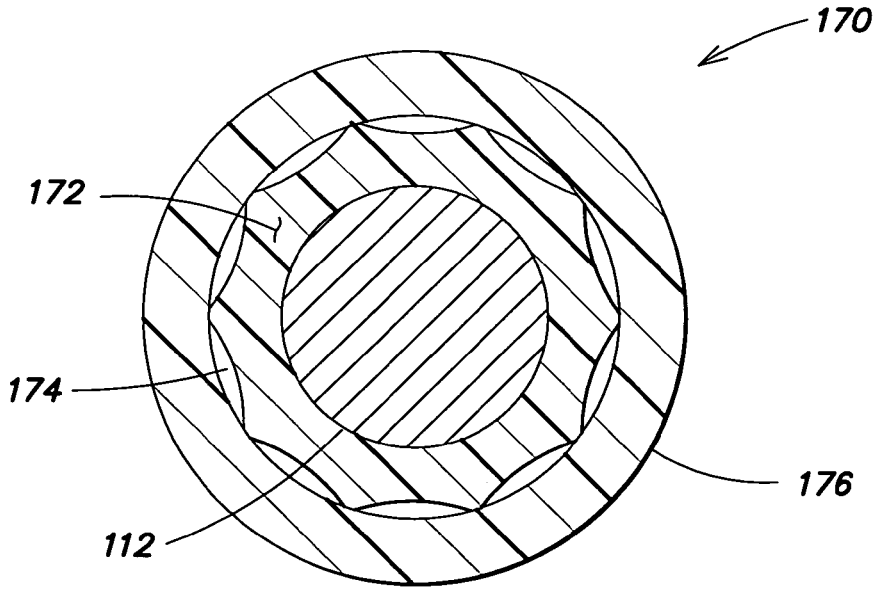
FIG. 10 is a cross-sectional diagram of a dual-layer insulated conductor according to another embodiment of the invention.

In another example, the second insulating layer may have a similar thickness to that of the first insulating layer 172, as illustrated in FIG. 10. In this example, the total combined thickness of the dual-layer insulation (comprising the first and second insulating layers) may be substantially similar to the thickness of a conventional round insulation layer 104 (see FIG. 1). However, the presence of the closed cells 174 reduces the amount of material (and cost) and reduces the effective dielectric constant of the dual-layer insulation by providing pockets of air within the insulation. As discussed above, lowering the effective dielectric constant of the insulation has advantages in that the NEXT between adjacent twisted pairs within a cable, and attenuation is proportionally reduced.

It is to be appreciated that the first and second insulating layers 172, 176 may be formed of the same material or may comprise different materials. Many combinations of materials are possible, for example, plenum cables may use a fluoropolymer layer, such as FEP, in combination with a non-fluorocarbon (such as polyethylene), for lower smoke generation. Desired results may be obtained by varying ratios of materials. Furthermore, the number and size of the indentations (closed cells) 174 may vary depending on a desired effective dielectric constant of the dual-layer insulation and on product safety considerations, such as, flammability and smoke generation. The closed cells 174 may be evenly or non-uniformly spaced about the outer circumference of the first insulating layer and may be similarly or varyingly sized.

In one embodiment, the first insulating layer 172 may be formed by extrusion, as known to those of skill in the art, and the indentations 174 may be formed by selecting a suitably shaped die for the extrusion process.

Figure 11:
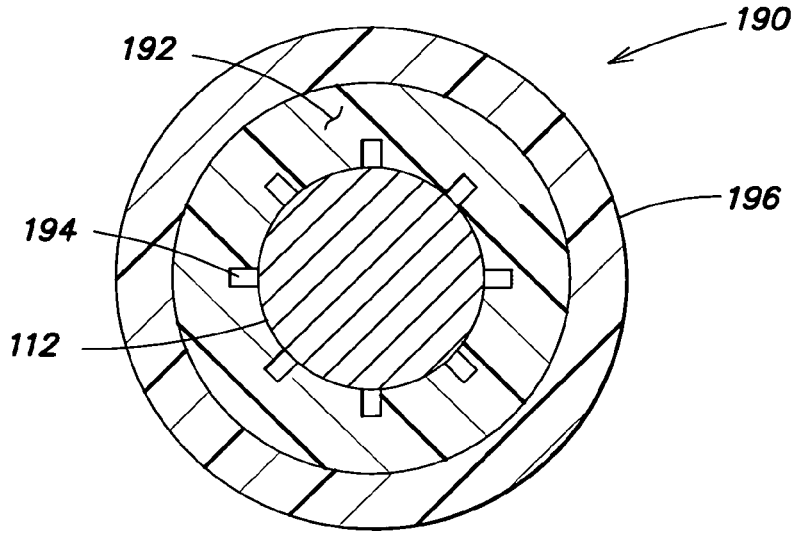
FIG. 11 is a cross-sectional diagram of a dual-layer insulated conductor according to another embodiment of the invention.

Referring to FIG. 11, there is illustrated another embodiment of an insulated conductor 190 having a dual-layer insulation, according to the invention. The insulated conductor 190 may comprise a metal core 112 surrounded by a first insulating layer 192 and a second insulating layer 196. Again the first insulating layer 192 may be constructed (e.g., extruded using a suitable die) to define a plurality of openings or indentations 194 spaced about an inner circumference of the first insulating layer 192. In the illustrated example, the plurality of indentations 194 form a plurality of open cells (with respect to the insulating layer 192) adjacent the metal core 112. As discussed above, the open cells serve to reduce the effective dielectric constant of the first insulating layer 192 which may advantageously reduce NEXT between adjacent twisted pairs of the insulated conductors 190, as well as attenuation and signal propagation time.

Figure 12:
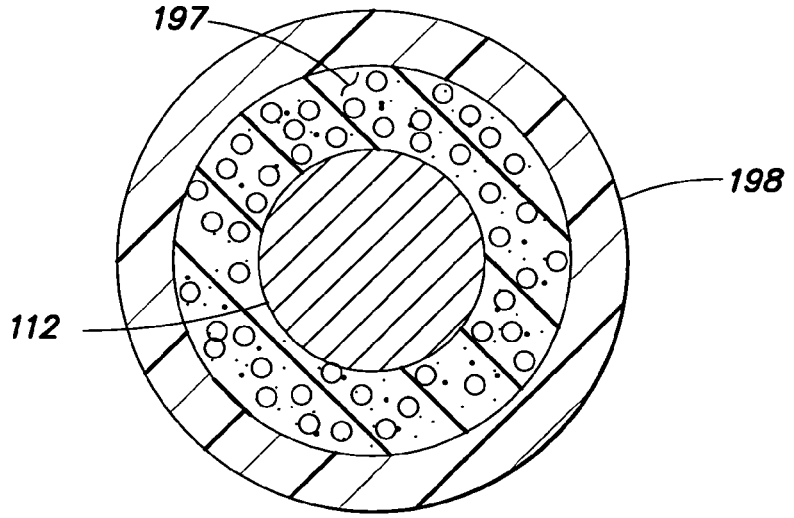
FIG. 12 (Related Art)
FIG. 12 is a cross-sectional diagram of a conventional dual-layer insulated conductor.

Some conventional cables comprise a dual-layer insulation having an inner layer 197 and outer layer 198, wherein the inner layer is a foamed material, as illustrated in FIG. 12. However, a foamed first layer 197 may be mechanically and structurally less robust than a solid layer due to the random or pseudo-random placement of air pockets throughout the foamed layer 197. Additionally, in order to produce the foamed material, an additional step of forcing gas into the insulation material is used during manufacture of the cable. The insulated conductors of the invention, for example, those illustrated in FIGS. 10 and 11, can achieve many of the same benefits of reduced material and lower effective dielectric constant that result from having the air pockets, but can also have a solid first insulation layer that may be mechanically stronger and easier and cheaper to manufacture than a conventional insulated conductor having a foamed layer of insulation.

Figure 13:
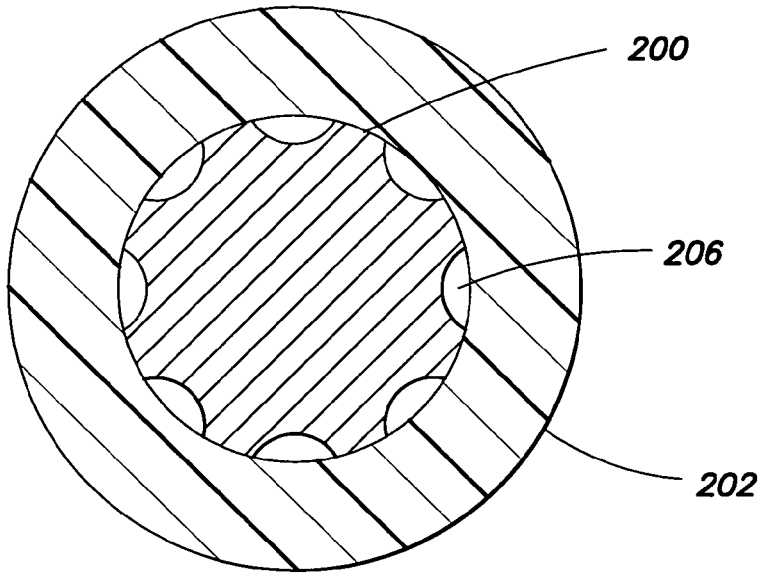
FIG. 13 is a cross-sectional diagram of an insulated conductor including a shaped conductor, according to another embodiment of the invention.
Figure 14:
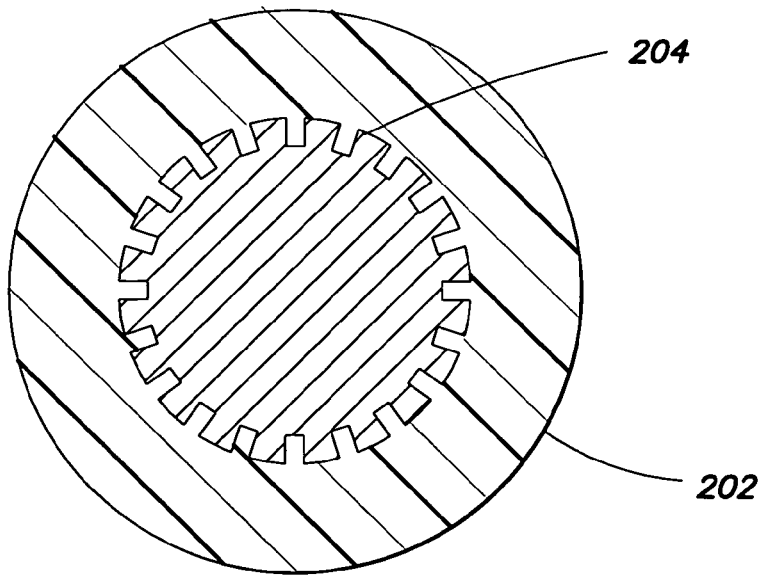
FIG. 14 is a cross-sectional diagram of an insulated conductor including a shaped conductor, according to another embodiment of the invention.

According to yet another embodiment of the invention, an insulated conductor may comprise a metal core having an irregularly-shaped outer surface surrounded by an insulation layer, as illustrated in FIGS. 13 and 14. For example, the metal core 200 may be formed so as to define a plurality of openings 206 spaced along a circumference of the metal core 200, as shown in FIG. 13. Alternatively, the metal core 204 may have a striated appearance, as shown in FIG. 14. The irregularly-shaped cores 200, 204 may allow for a better bond between the material of insulation layer 202 by providing a rough/larger surface area to which the insulation layer 202 can adhere. It is to be appreciated that with either of the shaped cores illustrated in FIGS. 13 and 14, the insulating layer 202 may overlay the openings 206 or may partially or completely fill the openings. Whether the insulating layer 202 covers or fills the openings may depend upon the material used to form the insulating layer and the pressure at which the insulating layer is extruded over the metal cores, among other factors. The irregularly-shaped cores may be formed using any of a variety of manufacturing methods. For example, the conductors (cores) may be scored using a 'pre-die' during the extrusion operation. Alternatively, the conductors may be 'micro-pitted,' this being done in an operation similar to sand blasting. These deformations of the metal cores (openings 206) may be used to hold pockets of air to thereby create a lower effective dielectric constant of the insulation surrounding the cores, or to provide for better adhesion of the insulating layer to the conductive core, as discussed above.

Various illustrative examples of geometrically optimized conductors have been described above in terms of particular dimensions and characteristics. However, it is to be appreciated that the invention is not limited to the specific examples described herein and the principles may be applied to a wide variety of insulated conductors for use many different types of cables. The above description is therefore by way of example only, and includes any modifications and improvements that may be apparent to one of skill in the art. The scope of the invention should be determined from proper construction of the appended claims and their equivalents.

What is claimed is:

1. A twisted pair of insulated conductors constructed for data communications comprising:

a first insulated conductor comprising a first conductive core and a first discrete insulating layer surrounding the first conductive core along its length; and a second insulated conductor comprising a second conductive core and a second discrete insulating layer surrounding the second conductive core along its length;

wherein the first and second insulating layers have a substantially oval widthwise cross-section;

wherein the first and second insulated conductors are twisted together to form the twisted pair constructed for data communications;

wherein the first insulated conductor does not include an outer conductor coaxially surrounding the first discrete insulating layer;

wherein the second insulated conductor does not include an outer conductor coaxially surrounding the second discrete insulating layer; and wherein the first and second conductive cores are substantially circular in cross-section.

2. The twisted pair of insulated conductors as claimed in claim 1, wherein the first and second insulated conductors are helically twisted together such that major axes of the first and second insulating layers periodically contact one another so as to provide a back-tensioning effect between the first and second insulated conductors after twist.

3. The twisted pair of insulated conductors as claimed in claim 1, wherein the first and second insulating layers comprise thicker portions and thinner portions, so as to provide the oval cross-section, and wherein each of the first and second insulating layers comprises two indentations in the thinner portions, the two indentations disposed substantially opposite one another.

4. The twisted pair of insulated conductors as claimed in claim 1, wherein each of the first and second insulating layers comprises a cavity extending toward, but not reaching, the first and second conductive cores, respectively.

5. The twisted pair of insulated conductors as claimed in claim 4, wherein each of the first and second insulating layers comprises thicker portions and thinner portions, thereby forming the oval widthwise cross-section; and wherein the cavity is disposed in one of the thinner portions.

6. The twisted pair of insulated conductors as claimed in claim 1, wherein at least one of the first and second insulating layers comprises a polyolefin material.

7. The twisted pair of insulated conductors as claimed in claim 1, wherein each of the first and second insulating layers comprises thicker portions and thinner portions, so as to provide the oval cross-section; and wherein the cavity is disposed in one of the thinner portions.

8. A data communications cable comprising:

a plurality of twisted pairs of insulated conductors constructed for data communications; and a jacket surrounding the plurality of twisted pairs along a length of the cable;

wherein each twisted pair of the plurality of twisted pairs is the twisted pair as claimed in claim 1.

* * * * *